US005386672A

United States Patent [19]

Iselin

[11] Patent Number: 5,386,672

[45] Date of Patent: Feb. 7, 1995

[54] MULTIPLE PERFORMANCE GLAZING

[76] Inventor: Franois Iselin, Chemin de la Girarde 15, 1066 Epalinges, Switzerland

[21] Appl. No.: 938,216

[22] PCT Filed: Feb. 17, 1992

[86] PCT No.: PCT/CH92/00030

§ 371 Date: Oct. 16, 1992

§ 102(e) Date: Oct. 16, 1992

[87] PCT Pub. No.: WO92/14899

PCT Pub. Date: Sep. 3, 1992

[30] Foreign Application Priority Data

Feb. 20, 1991 [CH] Switzerland ..... 532/91

[51] Int. Cl.[6] ..... E06B 3/66

[52] U.S. Cl. ..... 52/171.3

[58] Field of Search ..... 52/2.17, 2.19, 2.22, 52/171.1, 171.2, 171.3; 350/312

[56] References Cited

U.S. PATENT DOCUMENTS

| | | | |
|---|---|---|---|
| 3,475,868 | 11/1969 | Johnson | 52/2.16 |
| 3,761,165 | 9/1973 | Besnard | 350/312 |
| 3,903,665 | 9/1975 | Harrison | 52/171 |
| 4,044,519 | 8/1977 | Morin | 52/171 X |
| 4,074,482 | 2/1978 | Klahr . | |
| 4,093,352 | 6/1978 | Piscar | 52/171 X |
| 4,147,002 | 4/1979 | Kautz | 52/306 |
| 4,208,848 | 6/1980 | Kohl | 52/171 R |
| 4,231,202 | 11/1980 | Dube | 52/171 R |
| 4,236,360 | 12/1980 | Parrier | 52/171 R |
| 4,346,132 | 8/1982 | Cheng et al. . | |
| 5,009,044 | 4/1991 | Baughman | 52/171 |
| 5,106,660 | 4/1992 | Vorel | 52/171 R |
| 5,237,787 | 8/1993 | Grether | 52/171 |

FOREIGN PATENT DOCUMENTS

| | | | |
|---|---|---|---|
| 0044288 | 1/1982 | European Pat. Off. . | |
| 2555648 | 5/1985 | France . | |
| 2249543 | 4/1974 | Germany . | |
| 3048606 | 7/1982 | Germany | 52/171 R |
| 2227043 | 7/1990 | United Kingdom | 52/171 R |

OTHER PUBLICATIONS

International Appl. WO89/03925.

*Primary Examiner*—Carl D. Friedman
*Assistant Examiner*—Beth A. Aubrey
*Attorney, Agent, or Firm*—Clifford W. Browning

[57] ABSTRACT

The glazing is comprised of at least one housing (1) with at least two transparent, translucide or opaque walls (3, 3'), arranged to receive a filler foam which may be produced by blowing air or gas through a foaming liquid (7). As an alternative, the housing is arranged to receive a flexible plastic matrix with communicating cells.

20 Claims, 9 Drawing Sheets

MULTIPLE PERFORMANCE GLAZING

The present invention is concerned with multiperformance glazing.

Glazing constitutes a weak point from the aspect of both heat and sound in present buildings. For improving its performance, besides traditional forms of protection numerous fixed devices are employed, such as double or triple panes, known as insulating panes, synthetic plates with cells, reflective or absorbent panes, films interposed between the panes, translucent insulation fixed between the panes (for example, glass wool, silica gel, synthetic fibres), photosensitive or electrosensitive panes, etc.

These devices being fixed, modification of the performance of glazing to satisfy the needs and taking into account external energy suppliers is not possible. Thus these types of glazing are good traps but not very good insulators or good insulators but poor traps.

Various solutions have been proposed for improving the performance of double glazing. The most interesting consist in replacing the traditional airspace confined between two panes by other retractable elements which may be gaseous, liquid or solid.

a) Enclosures with gaseous filling:

One first solution is to replace the ambient air by dehydrated air, which enables the risks to be eliminated of the ambient air being charged with fog and dust, but gives no improvement as regards heat or sound with respect to the ambient air. A slight improvement in the thermal insulation may be obtained when the filling is effected with a gas. This thermal improvement is very marked when a vacuum is created in the enclosure (glazing known as "evacuated"). The main disadvantages of enclosures having a gaseous filling, however, lie in particular on the one hand in that it is necessary to replace both panes in the event of breakage and on the other hand in the fragility of the gastight Joint and in the fact that these solutions necessitate complementary protective devices for solar obscuration. Again in the case of vacuum glazing the powerful reduced pressures created necessitate separating wedges.

b) Enclosures with liquid filling:

This solution consists in making liquids (aqueous or oily liquids) which are coloured or charged with aggregates, circulate in one or more sheets of air by means of a pump. Such devices are described, for example, in the Swiss Patent No. 627818 and English Patent No. 2227043. The main advantage of this type of enclosure with respect to enclosures with gaseous filling is that filling is reversible and the liquids may be coloured. Their main disadvantage is that they cause very unfavourable thermal insulation and that they may even present risks of freezing or evaporation. Again, deposits may occur upon the panes, reducing their transparency. On the other hand the liquid filling necessitates particularly careful liquidtight joints.

c) Enclosures with solid filling:

The granules employed for the filling may be solid granules or semi-porous granules, semi-porous granules enabling good thermal insulation.

As with enclosures with liquid filling the main advantage of enclosures with solid filling is that the filling is reversible. On the other hand they have as their main disadvantages the high weight and volume of the filling matter and necessitate a very considerable apparatus for the circulation of the material.

d) Enclosures with porous filling:

The filling may be effected either with porous granules or with silica aerogels.

In the first case the porous granules, for example balls of expanded polystyrene, have the advantage of being very light, insulating and translucent. On the other hand these granules have the disadvantage of adhering to the panes if an antistatic solution is not applied periodically. Moreover, the resin of the polystyrene balls is sensitive to ultra-violet solar radiation, which causes them to become yellow and fragile.

Silica aerogels likewise have the advantage of enabling a very light and insulating filling. Moreover, they are perfectly transparent. Among their disadvantages may be mentioned the fact that veiling and obscuration must be ensured by other means, and also the instability of the gels. Moreover, their cost at present is very high. In addition the main disadvantage of this porous filling lies in that it is not reversible.

The aim of the present invention is to correct the disadvantages of the solutions which have been proposed hitherto, so as to improve the physical and/or aesthetic performance of the glazed envelopes and to enable a variation in the performance of the glazing in the face of the needs.

For this purpose the invention is concerned with multi-performance glazing comprising at least one enclosure having at least two transparent, translucent or opaque walls and arranged to receive filling matter, as defined in claim 1 or claim 11. Other important characteristics of the invention are the object of the claims subordinate to claim 1.

In comparison with filling the sheets of air by means of a gas, a liquid or solid granules, filling with a reversible foam offers in particular the following advantages:

- the insulation is light and comparable with silica aerogels. The filling pressure exerted upon the glass walls is negligible;
- the storage weight and volume of the filling matter are negligible, which enables completely glazed and light panels to be produced;
- the differences in pressure necessary for producing and injecting the foam into the airspace are very low;
- the translucency of the foams is good and much higher than that of solid granules obtained on a base of synthetic resin;
- the density and hence the translucency and the insulating power of the foams may be differentiated by employing the same liquid and the same gas but by producing the foam through nozzles of different apertures.

In short, the foams are very light, insulating and translucent materials. The cost of the filling matter is very low and its bulk negligible.

Other advantages of the glazing of the invention will become apparent from the description, given by way of example, which follows and refers to the attached drawing in which.

Figure 4A:
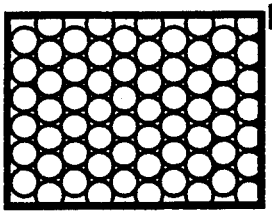
Figure 4B:
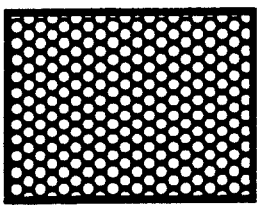
Figure 4C:
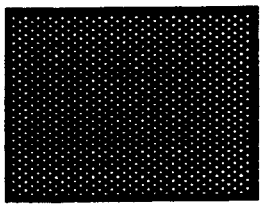
Figure 1:
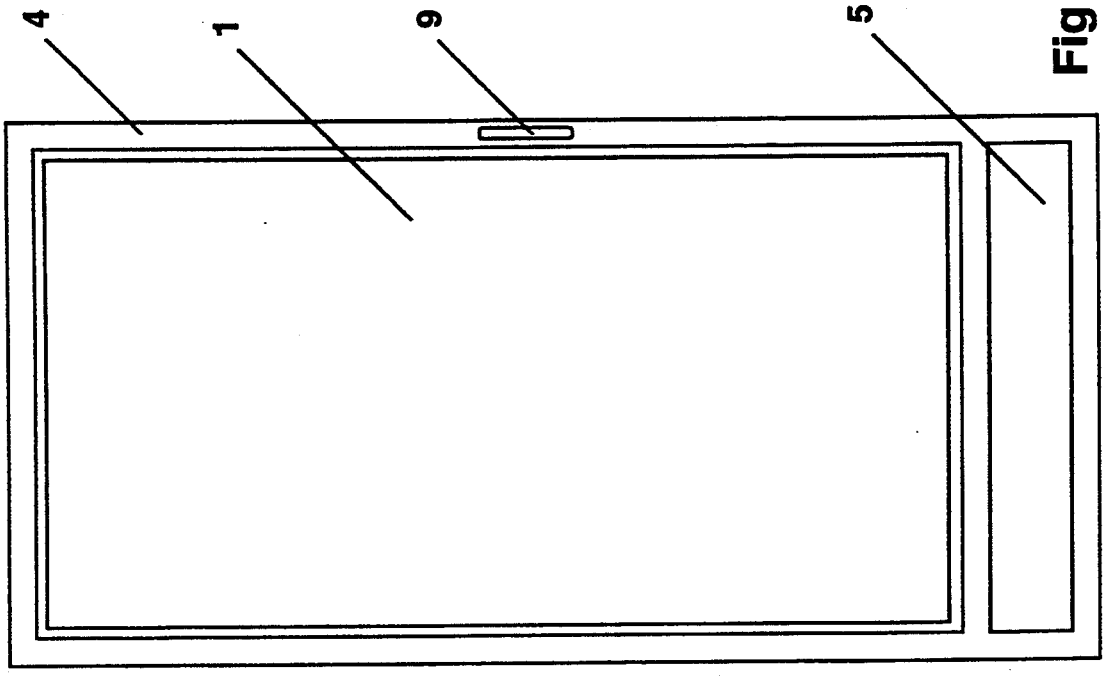
FIG. 1 is a diagrammatic elevation of one example of glazing in accordance with the invention.
Figure 5:
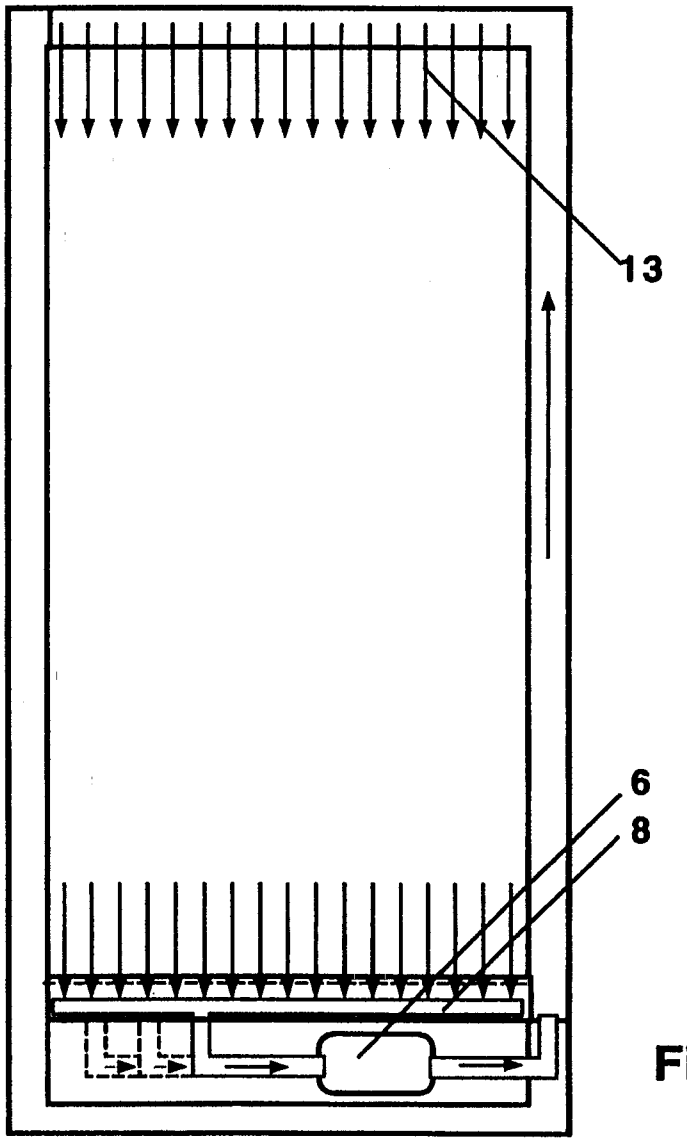
Figure 6:
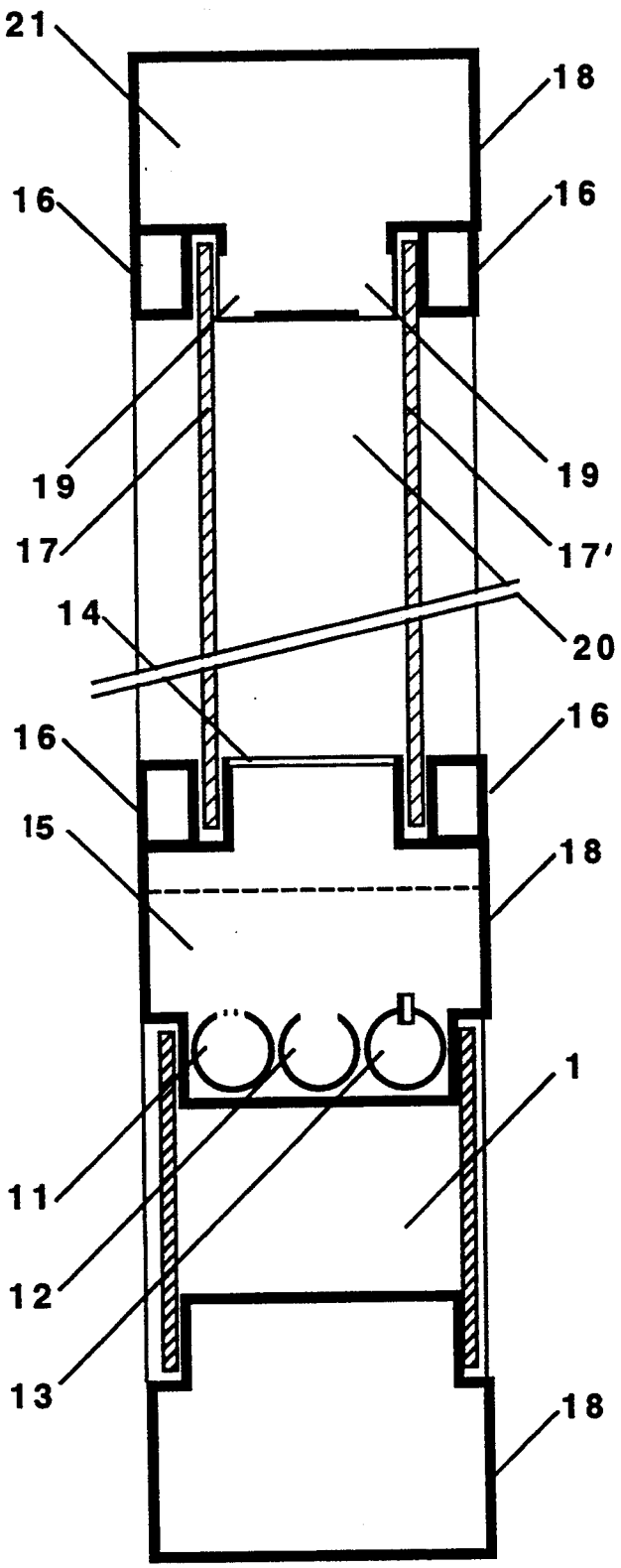
Figure 7A:
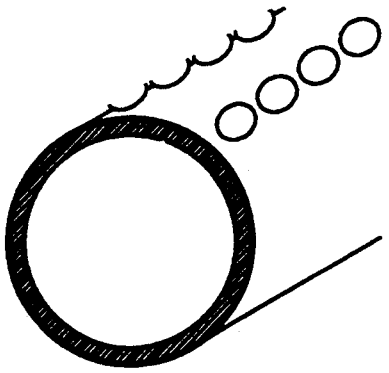
Figure 7B:
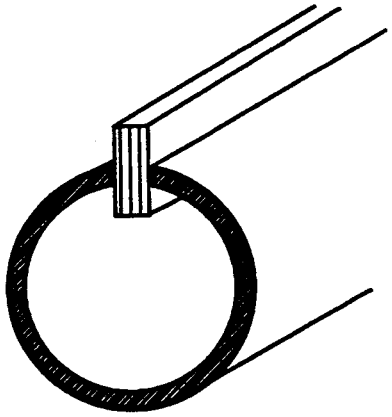
Figure 7C:
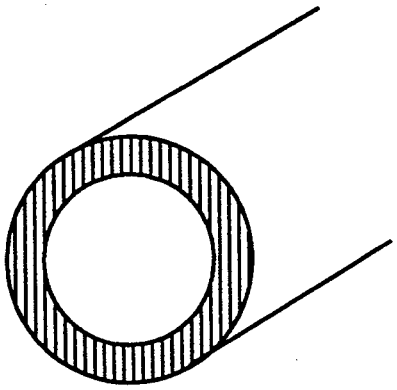
Figure 9:
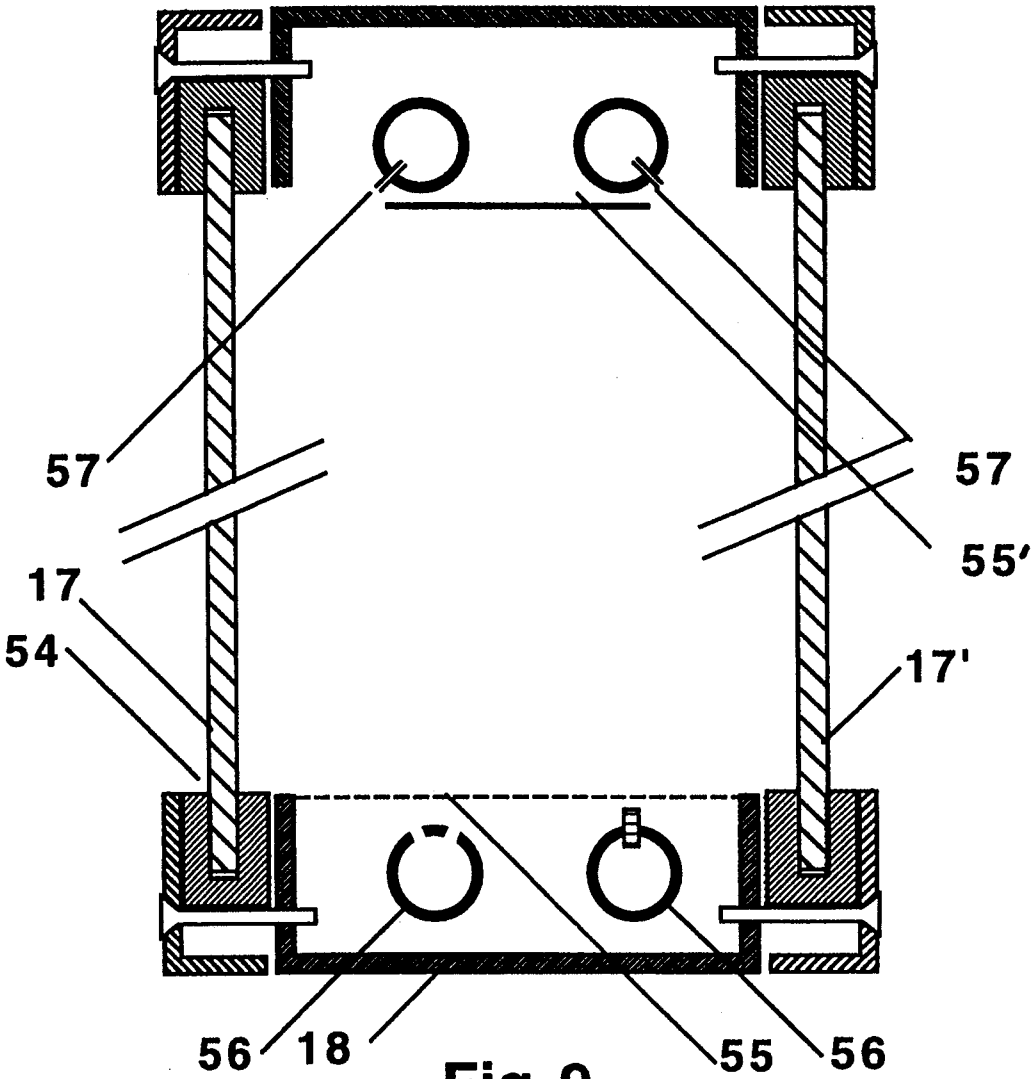
Figure 8:
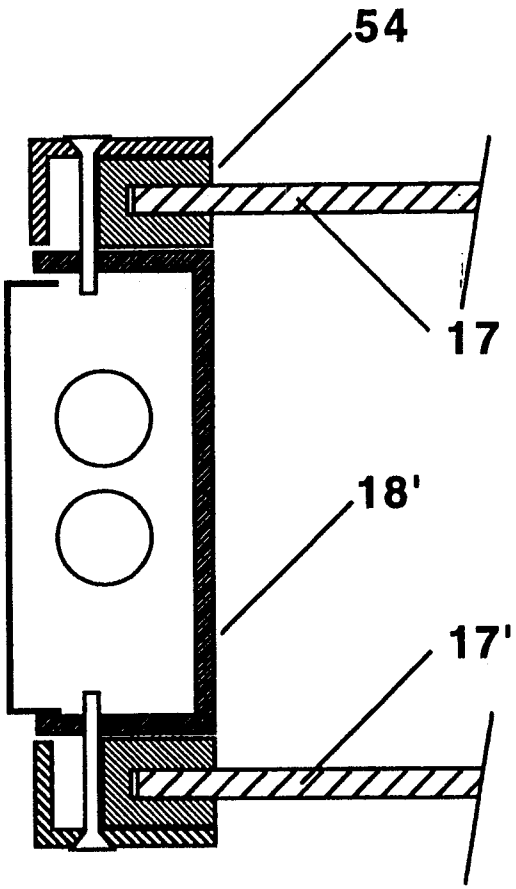
Figure 11:
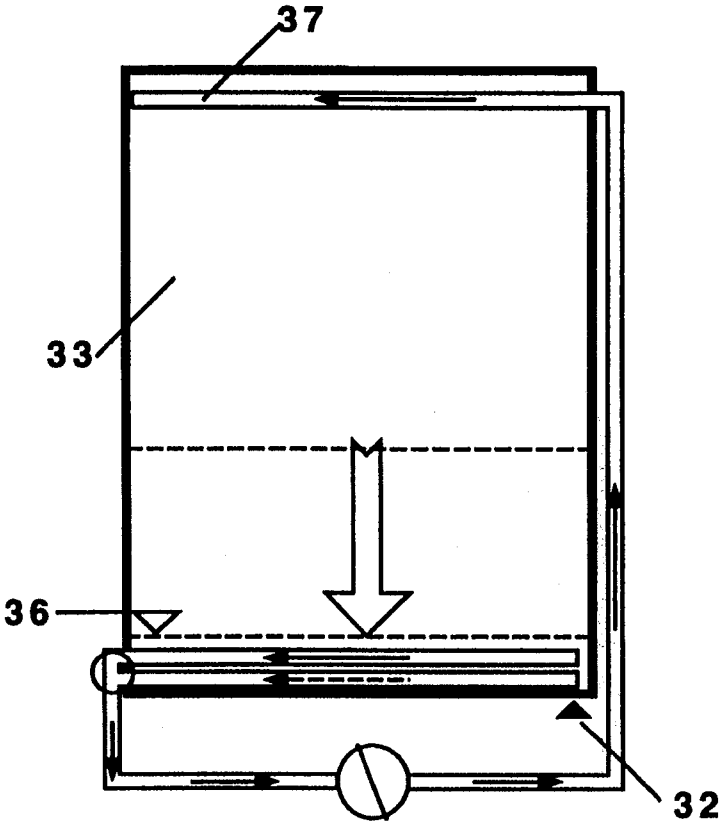
Figure 10:
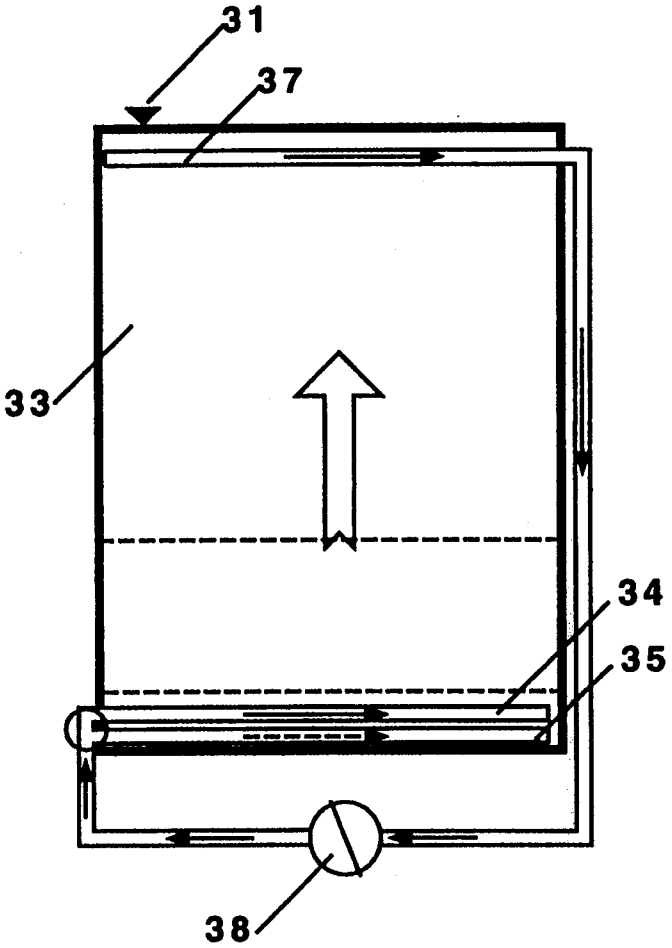
Figure 13:
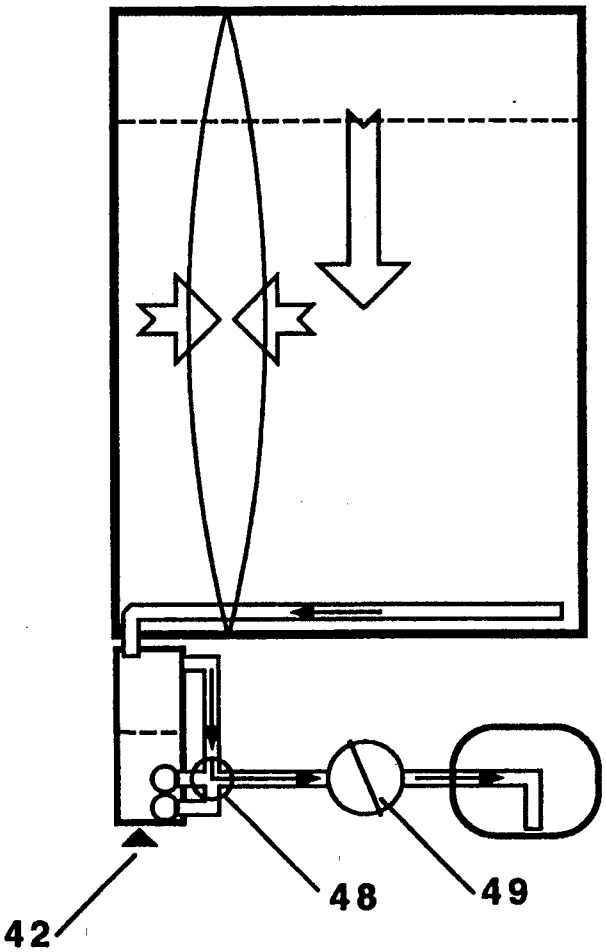
Figure 12:
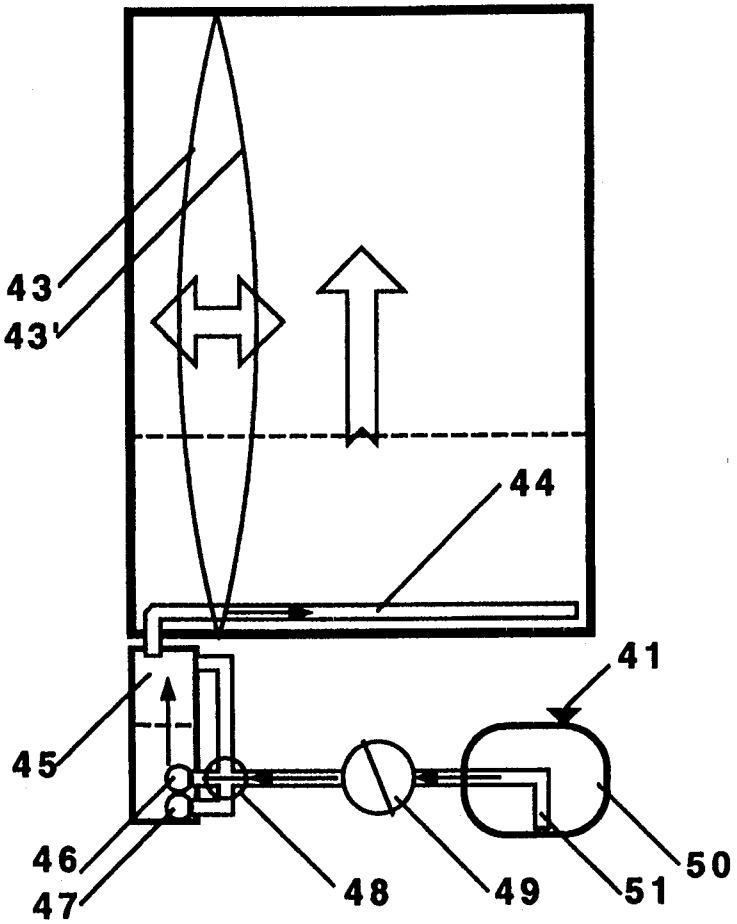
Figure 14:
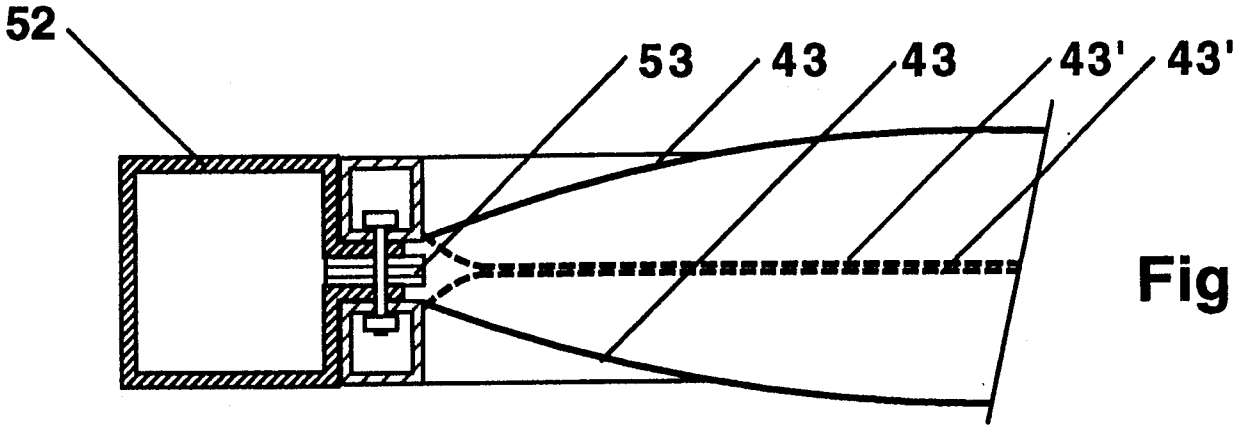
Figure 15:
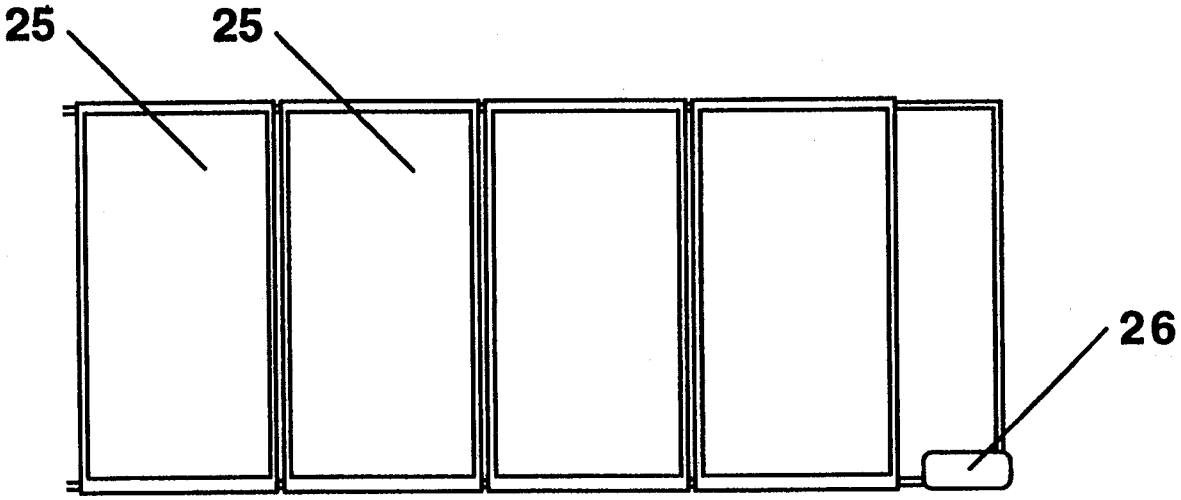
Figure 17A:
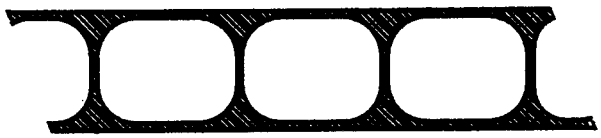
Figure 17B:
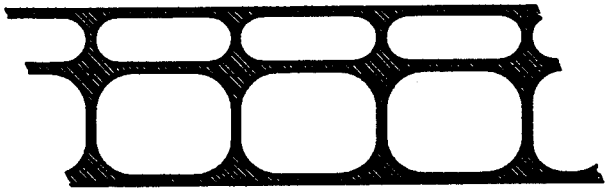

FIGS. 4*a* to 4*c* illustrate various densities of filling of the airspace in the enclosure by foams the bubbles of which have different diameters;

FIG. 5 is a diagram of the principle operation of the glazing as FIG. 1, illustrating the emptying of the enclosure;

FIG. 6 is a diagrammatic partial vertical cross-section of a glazing as FIG. 1 in detail;

FIGS. 7*a* to 7*c* illustrate various types of bubbler distributors;

FIG. 8 is a partial horizontal section illustrating a detail at the level of the frame of the variant as FIGS. 10 and 11;

FIG. 9 is a partial vertical section illustrating a detail at the level of the frame of the variant as FIGS. 10 and 11;

FIG. 10 is a schematic diagram of the filling of a glazing having rigid transparent sheets;

FIG. 11 is a schematic diagram of the emptying of the glazing as FIG. 10;

FIG. 12 is a schematic diagram of the filling of a glazing having flexible transparent membranes;

FIG. 13 is a schematic diagram of the emptying of the glazing as FIG. 12;

FIG. 14 is a partial horizontal or a vertical section of an embodiment of glazing having flexible transparent membranes as FIGS. 12 and 13;

FIG. 15 illustrates an example of combination of a number of glazing units in accordance with the invention, fed by a single filling device;

FIGS. 16*a* to 16*e* illustrate diagrammatically a number of examples in accordance with the invention, in vertical section;

FIGS. 17*a* and 17*b* exhibit two profiles of rigid plates available on the market, seen in horizontal section and capable of equipping variant 16*e;*

Figure 19D:
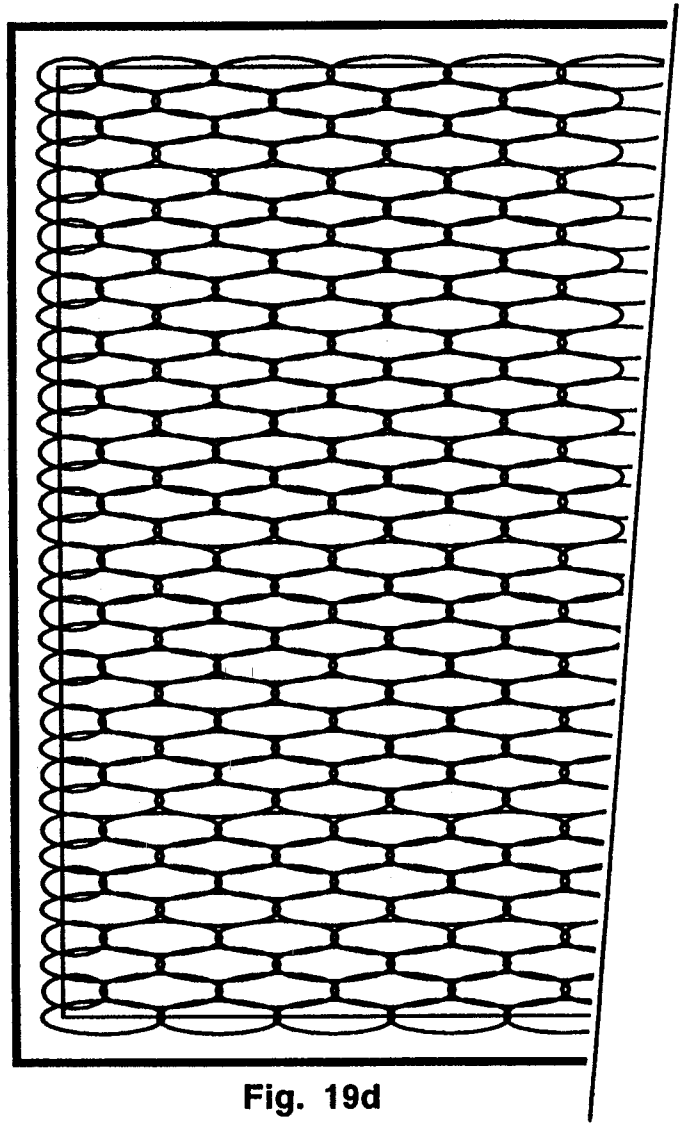
Figure 19C:
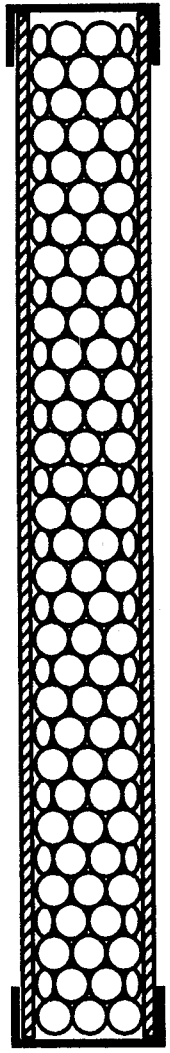
Figure 19B:
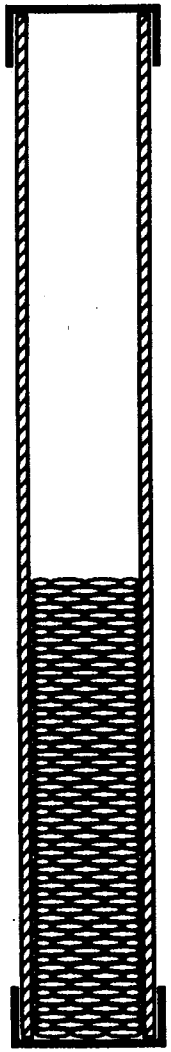
Figure 19A:
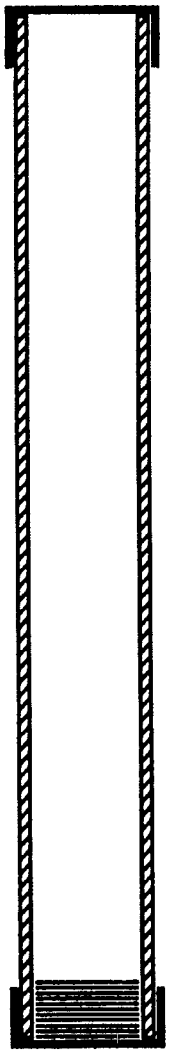
Figure 18:
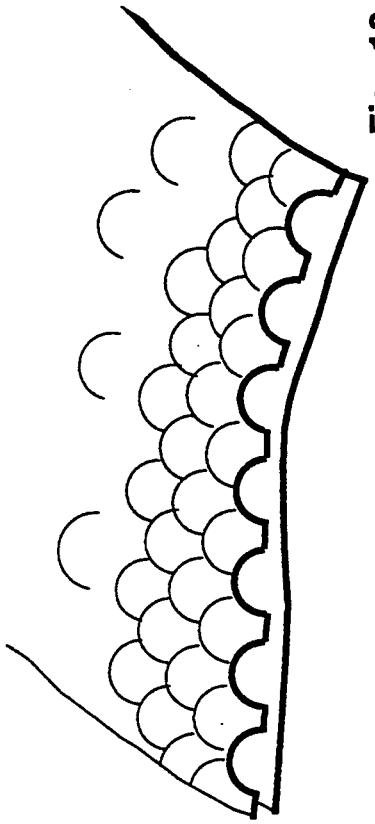

FIG. 18 illustrates a double membrane of embossed synthetic matter in which the cells communicate; and FIGS. 19*a* to 19*d* illustrate the filling of an airspace by an inflatable bed consisting of communicating cells. FIGS. 19*a* to 19*c* are sections and FIG. 19*d* is a view of the glazing.

The glazing may consist of one or more hermetically closed enclosures. Each enclosure forms a glazing module, where the modules may be combined at will. Each enclosure includes a frame and transparent, translucent or opaque walls. The enclosure may be filled with foam or emptied to meet the needs of the thermal and sound insulation, of obscuration or veiling or with other aims such as the decoration or colouration of walls, by the foam proceeding from a liquid or under certain conditions by the liquid itself. The filling of the enclosure may be effected partially or completely as needed. The foam increases the thermal and sound insulation of the enclosure. Its translucency or its opacity depend upon the dimensions of the bubbles of air which form it. The foam may in short be more or less dense depending upon the nature of the liquid and its production by the bubbling of the gas in distributors including nozzles of greater or less diameter.

The injection of air may be effected by means of a single nozzle or by a number of nozzles arranged along a distributor. The term distributor employed in this description covers any device equipped with at least one nozzle.

What is designated here by the term "glazing" is any kind of envelope which must be transparent or translucent and employable for buildings, machines for transport, horticultural greenhouses, solar traps, etc. The glazing may be vertical, horizontal or sloping. It may be plane (such as windows, glass doors, facades) or curved (such as the coverings of glass casings, verandahs or horticultural green-houses) or have a double curvature (such as cupolas and double-shelled domes). Although the term glazing is applied to envelopes equipped with panes of glass, the walls of the enclosure in accordance with the invention may equally well consist of flexible films such as those employed for agricultural greenhouses, cultures under cloches or constructions known as "textiles".

Similarly within the scope of the present description the term liquid designates the solution which enables a foam to be produced by bubbling air or gas, this foam being intended for being injected into the airspace between the glass walls.

Figure 2:
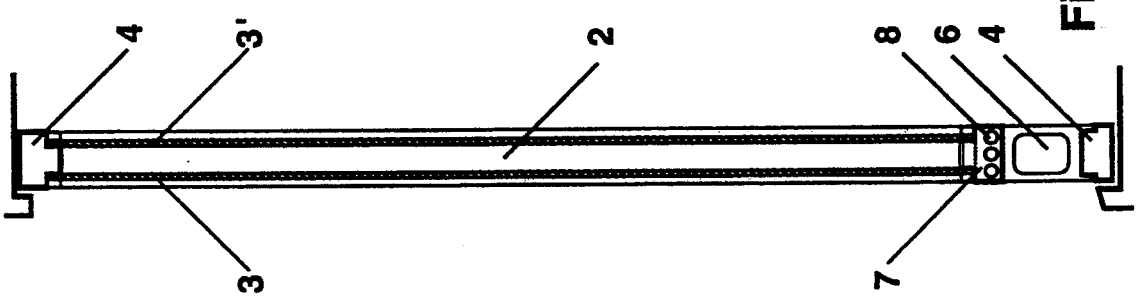
FIG. 2 is a diagrammatic vertical cross-section of the glazing as FIG. 1.
Figure 3:
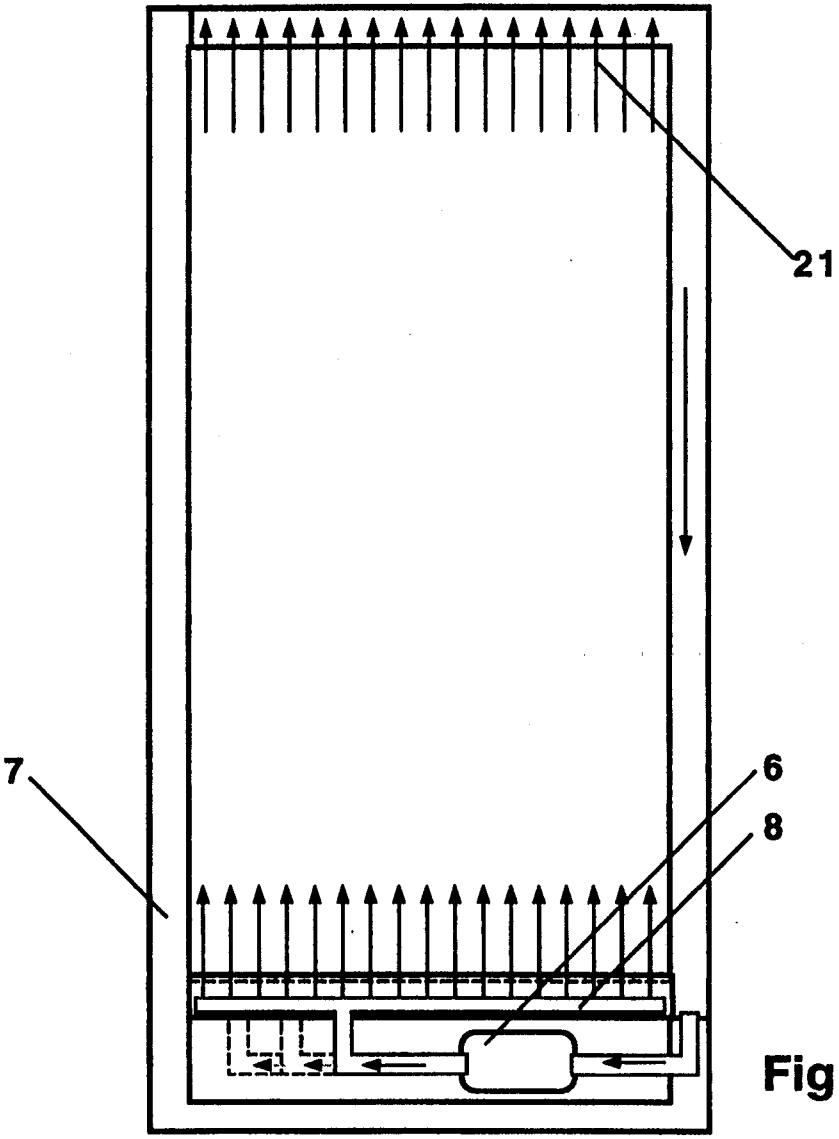
FIG. 3 is a diagram of the principle of operation of the glazing as FIG. 1, illustrating the filling of the enclosure.

The enclosure represented in FIGS. 1 and 2 includes a glazing unit 1 itself, an airspace 2 confined between two transparent, translucent or opaque walls 3, 3', mounted in a frame 4. A technical space 5 may be provided in the lower portion of the enclosure. It comprises a pump 6 and other elements necessary to the operation of the enclosure such, for example, as a selector switch actuated by means of the control 9. At the upper portion of the technical space is found a liquid reservoir 7 in which are arranged one or more bubblers 8 for the production of foam. The installation comprises in addition pipes, valves and gates which may be housed in the frames 4 when the latter are hollow. Diagrams of the operating principle of the enclosure, illustrating the filling and emptying of the enclosure, are represented in FIGS. 3 and 5. The pump 6 is reversible. In the filling mode it pumps the gaseous fluid, for example, air present in the enclosure, by sucking it through the overflow 21 at the upper portion of the enclosure. This air is then blown into the bubbler or bubblers 8. In the emptying mode the pump sucks the liquid 7 through the distributors and propels it to the upper portion of the enclosure 13 so as to set it streaming down the walls.

As the walls 3, 3' are not subjected to any other pressure than that exerted by their own weight, they may be made of traditional materials such as glass or plastics matter, whether transparent, translucent or opaque, as well as of flexible materials such as synthetic films. Enclosures which, for example, combine one rigid wall and one flexible wall are possible. Similarly one transparent wall may be combined with one translucent or opaque wall. For stretching the walls consisting of flexible films a slight overpressure may be created in the enclosure by means of the same pump as that employed for the production of the foam. Transparency is reestablished by evacuating the foam, which makes the two films cling together.

The thickness of the airspace 2 between the walls 3, 3' may be from a millimeter to a decimeter, depending upon the performance which is expected of the foam. For example, for obtaining a thermal and sound insulating power near to that of an insulated front wall, thicknesses of the order of a decimeter will be employed.

By way of indication and comparison, for an airspace of 1 decimeter, the thermal conductivities K (Watt/m2.K) obtained may be approximately the following:

Filling with air=2.5;

Filling with translucent foam (diameter of the pores about 10 millimeters)=1.5;

Filling with opaque foam (diameter of the pores about 0.1 millimeters)=0.5.

The frames of the enclosure may like the frames of traditional glazing be produced from steel, aluminium, PVC, etc. They must be designed so that they are perfectly air and liquidtight, that they are not degradable by the latter and that they enable the walls to be fixed in a tight manner. When thermal insulation is required it is well to take care that the thermal conductivity of the frames is as low as possible. For doing this one employs the principle of a thermal gap between the two faces of the frame or in the case of glazing with multiple modules, between these modules.

The liquid and the gas are confined in hermetically closed enclosures and the foam circulates in a closed circuit, preventing their contamination. For preventing variations in pressure the closed space may be connected to a pressure-balancing balloon in order to prevent the excessive strains on the glass walls produced by the variations in atmospheric pressure and the thermal expansion of the confined air. In enclosures having walls of flexible film the foam is produced so as to cause the enclosure to inflate. The pressure in the enclosure is in this case higher than atmospheric pressure, which enables the flexible films to be stretched and thus made rigid.

The enclosures may be designed so as to be able to be combined at will as needed, for example, as a function of the orientation of the front walls or of the intended locations. By way of example, a wall which includes a number of glazing units 25 fed by a single feed device 26 is represented in FIG. 15.

Where the glazing consists of a number of modules, each may include a liquid the properties of which are different, so as to correspond with the characteristics desired of the module (insulation, veiling, passive solar trapping, solar protection, etc.).

The solution may consist of a liquid composed, for example, of water, isopropyl alcohol, a wetting agent, soap, paraffin, sugar, glycol, colouring matter, particles in suspension, etc. Other liquids on a base of silicon oil may be employed.

The liquids employed must have properties suitable for causing foaming by bubbling gas through the nozzles. Their thermal conductivity must be as low as possible. They must have good stability against solar radiation, in particular against the ultraviolet range, and must not corrode the materials of the enclosure nor produce fog on the panes at the time of their evaporation. On the other hand when there is a risk of their being exposed to low temperatures they must be non-freezing. Again, the foams produced must not leave deposits, drops, tracks or bubbles on the walls of the glazing after their removal. These problems can be solved by the addition of wetting agents to the liquid so that the condensates then form no fog but a regular transparent and invisible thin film.

The gas passed into the liquid may be air or any other gas. In accordance with a preferred embodiment as represented in the variants as FIGS. 1 to 3, 10 and 11 and 12 and 13, the liquid and the foam circulate in closed circuit, which enables impurities to be prevented from getting into the enclosures.

The pressure of the gas necessary for the production of foam is obtained by an electric or hand pump 6 or by compressed air cartridges or any other means. One may, for example, employ peristaltic pumps to ensure the circulation of the air and liquid or electric or hand compressors. These devices likewise enable an enclosure to be filled with liquid. They may equally well be employed for degassing the foams.

In accordance with one variant the production of the foam may likewise be effected by mechanical agitation of the liquid.

Pipes for the circulation of the liquid, gas and foam may be arranged in the profiled sections when the latter are hollow.

The detail of an example of double glazing with clear glass panes 17, 17' arranged in a frame 18 is represented in FIG. 6. The foam may be produced by blowing air or gas into the airspace 20 by means of nozzles at certain points or placed along one or more feed distributors immersed in the liquid 15. Three feed distributors are represented in this example: a fine diffusion distributor 11, a coarse diffusion distributor 12 and a middling diffusion distributor 13. Likewise represented in this Figure are: the orifices 14 for circulation of the foam, subframes 16 for fixing the panes, an overflow duct 21 which may be equipped with perforations 19 so as to be able to work as a glass-washer.

Various types of distributor are represented in FIGS. *7a* to *7c*. FIG. *7a* illustrates a pierced tube. When the diameter of the tube is too small for one to be able to pierce it, tubes of microporous material (FIG. *7c*) may be employed, such as porous ceramics, porous plastics or the like. One may equally well employ a split tube equipped with a band of foam or felt such as that represented in FIG. *7b*.

The horizontal arrangement of the distributors and their length over the whole width of the enclosure enables a curtain of foam to be obtained, the crest of which is horizontal. In order to avoid the curtain of foam being heterogeneous it must be ensured that the distributors are perfectly horizontal. The foam may be produced in one compartment and then pumped into pipework feeding one or more glazing units.

In order that the curtain of foam completely fills the enclosure and that the air can be evacuated, the top of the enclosure is provided with an overflow 21 flowing away into the liquid reservoir.

FIGS. 8 and 9 illustrate the variant (FIG. 10) of mounting the panes 17, 17' on a frame 18' with joint seals 54. In FIG. 9 one may distinguish injection distributors 56 and pipes 57 intended for flushing the inside of the glazing by setting liquid streaming down the walls. Gratings 55, 55' are provided for the sake of appearance.

One example of mounting the membranes 43, 43' of a glazing having flexible membranes (variant of FIG. 12) on a frame 52 is illustrated in FIG. 14. In accordance with the embodiment shown, the frame 52 serves as a duct for conveying the foam round the whole perimeter of the enclosure, the foam penetrating into the enclosure by way of an element 53 of felt or porous matter. After extraction of the foam the membranes return to the position indicated at 43'.

The speed of filling depends upon the delivery of the pump and the volume to be filled. The pump may be stopped automatically after the filling by means of an adjustable timer. By stopping the pump by hand during the course of filling, the curtain of foam may be limited to only one portion of the surface of the enclosure.

A number of types of foam may be obtained with the same liquid in the same enclosure by blowing the gas in through distributors of different characteristics. For example, the following different types of foam may be realized:

Veiling foam:

The diameter of the bubbles is of the order of a centimeter or more (FIG. 4*a*). There are consequently only a few membranes of bubbles between the two glass walls of the enclosure. This type of foam suppresses vision from one side of the transparent enclosure to the other but reduces only very weakly the admission of light. The insulating properties of this foam are limited. It is selected when it is desired to obtain simultaneously visual privacy and the maximum of light. It has a transparent and irridescent aspect under light.

Translucent foam:

This foam is more dense and the transmission of light is greatly reduced (FIG. 4*b*). It is selected when it is desired to attenuate or protect oneself from intense light, in particular direct solar radiation. Whatever the colour of the liquid this foam remains whitish.

Opaque foam:

This foam is very dense (FIG. 4*c*). It consists of microscopic bubbles. Its performance as thermal insulation is a maximum and the transparency zero. This solution is selected when one desires both complete obscuration, maximum thermal and sound insulation or a white and reflective colouration of the glazing.

Degassing may be effected mechanically by sucking the foam into a microporous distributor. The liquid leaving the degassing is recovered. The destruction of the foam may equally well be effected spontaneously. In this case the liquid is prepared in such a way that the foam degasses after a given time (from one minute to half-an-hour, for example). The permanence of the complete filling with foam is then ensured by setting the pump running slowly or periodically. Discharge of the foam adhering to the glazing may be effected by setting liquid streaming down the glazed surfaces thanks, for example, to the perforations 19 (FIG. 6).

The control of the functions of filling and emptying is effected by means of a control system 9 (FIG. 1) situated on or near the glazing. The control system comprises in general a switch, a delivery reverser and a means of varying the pump speed, as well as a three-way valve (emptying, filling with opaque foam and filling with translucent foam). These controls may be combined into one single handle presenting four positions: "Screen filling" (starting the pump and opening the corresponding filling circuit), "veiling filling", "emptying" (reversal of the flow from the pump and opening of the emptying circuit), "stop" (stopping of the pump by hand or by timeswitch).

The liquid employed for the formation of foams may be employed as such for filling an enclosure the space between the walls of which is preferably thin or even capillary. In this case the liquid may be coloured or charged with particles in suspension. It may be observed that these particles remain at the bottom of the reservoir at the time of production of the foam and that the colouration will not affect the white colour of the latter. A glazing may, for example, be realized with a double enclosure, the one arranged for being filled with the foam and the other with the liquid. Numerous combinations are of course possible, depending upon the effect sought.

The glazing of the invention enables envelopes to be obtained of enhanced performance variable to suit the needs, without calling upon traditional protective devices such as shutters, blinds, curtains, etc. It enables the thermal losses of glazed envelopes to be reduced considerably without their thereby losing their translucency and without depriving oneself of solar admissions. Glazings of this type may advantageously be employed as the glazing in buildings, verandahs, domes, glass casings of display rooms, sheds of industrial buildings, horticultural greenhouses, textile structures, solar traps, etc.

In order to enable maintenance of the glazing, the liquid must be able to be easily replaced and the enclosure rinsed out. For doing that an emptying valve and a filling valve are provided. In addition the airspace must be accessible for cleaning the walls, maintenance or replacement of nozzles, etc.

Diagrammatic examples of the filling and emptying circuit of a glazing having rigid transparent panes 33 are represented in FIGS. 10 and 11. The translucency and the opacity are obtained by injection of light and dense foam produced by nozzles ad hoc. Transparency is reestablished at the time of degassing these foams and setting liquid to stream down the panes. The foams employed in this frame may have a reduced stability. This principle may be employed for glazing traditionally employed in architecture (windows, glass doors, domes, sheds, verandahs, glass partitions, etc.). The daily admissions of natural noon light are proportioned to suit the needs by making the transparency of the foam filling vary. Thermal losses at night are reduced by filling the enclosure with dense foams. This glazing includes a valve 31 for filling, a valve 32 for emptying, a distributor 34 for producing dense foam and recovering the liquid, a distributor 35 for producing light foam and recovering the liquid, a pipe 37 for the foam overflow and the projection of the liquid over the panes and a reversible-delivery peristaltic or other electric pump 38. The level of the foaming liquid is represented by 36.

Diagrammatic examples of the filling and emptying circuit of glazing having transparent flexible membranes 43 are represented in FIGS. 12 and 13. This application enables glazing to be obtained of which the transparency, the translucency and the opacity are regulated by the injection of variable amounts of foam. Hence the mean thickness of the space between the membranes is variable, which enables variations in transparency to be obtained almost instantaneously. In this case a foam will be employed which exhibits high stability. Glazing of this type may be employed for envelopes of plastics matter (PE, PVC, PTFE, etc), cultures under shelter such as greenhouses, tunnels or stacks, where solar protection by day and thermal insulation at night are desirable or necessary. This glazing includes a valve 41 for filling, a valve 42 for emptying, a foam distributor/recuperator 44, a rigid enclosure 45 for the production of foam (necessary only when it is desired to employ various types of foam), a nozzle 46 for dense opaque foam, a nozzle 47 for light translucent foam, a reversible-delivery peristaltic electric pump 49 and a three-way valve 48 for controlling the type of foam, the starting and reversal of the direction of rotation of the pump. The foam is stored in a flexible reservoir 50 from which it is extracted by a dip tube 51 in order to be reused.

Figure 16E:
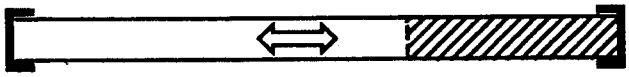
Figure 16D:
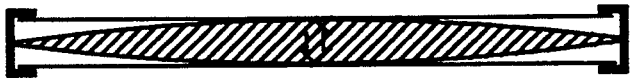
Figure 16C:
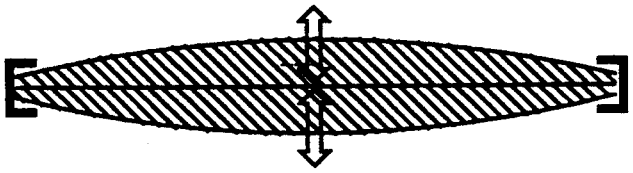
Figure 16B:
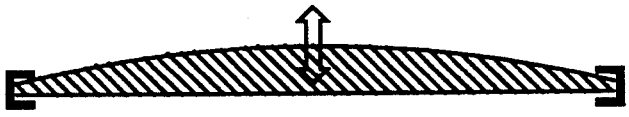
Figure 16A:
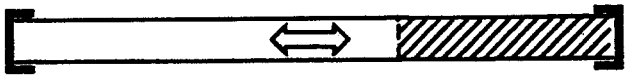

By way of example various types of glazing in accordance with the invention are represented in FIGS. 16*a* to 16*e*, viz: A glazing with double panes (FIG. 16*a*), a mixed double glazing (FIG. 16*b*), a mixed triple glazing (FIG. 16*c*), a mixed quadruple glazing (FIG. 16*d*) and a glazing with a rigid cellular synthetic plate (FIG. 16*e*). Examples of profiles of such plates are represented in FIGS. 17*a* and 17*b* in horizontal section. Finally a double membrane of embossed synthetic matter with communicating cells is represented in FIG. 18.

The principle of foam produced by bubbling gas into a foaming liquid and expanding into an enclosure may be extended to a bed consisting of flexible plastics matter with communicating cells. The inflation and deflation of the bed is effected by a reversible air pump. At the time of its inflation the bed is expanded so as to fill the enclosure partially (FIG. 19*b*) or completely (FIG. 19*c*). At the time of its deflation the bed is contracted so as to be retracted (FIG. 19*a*).

I claim:

1. Multiperformance glazing comprising at least one enclosure which has at least two transparent, translucent or opaque walls and is arranged to receive filling matter, wherein the filling matter is a foam obtained from a liquid that becomes a foam when gas is introduced into the liquid and that thereafter becomes a liquid when gas either escapes or is removed from the foam, and means to introduce gas into the liquid including at least one distributor immersed in the liquid having means to selectively produce gas bubbles of different sizes, whereby foams having different physical characteristics can be selectively produced, and means to remove gas from the foam.

2. Glazing as in claim 1, wherein the foam is produced by bubbling gas through the liquid.

3. Glazing as in claim 2, wherein the walls are of rigid material.

4. Glazing as in claim 2, wherein at least one of the walls is of flexible material.

5. Glazing as in claim 2, including a device for setting liquid streaming down the walls.

6. Glazing as in claim 2, including at least one second enclosure intended for a liquid filling.

7. Glazing as in claim 2, and further comprising a technical enclosure which includes a reservoir for liquid in which is immersed at least one bubbler intended for bubbling a gas through the liquid under the action of a pump.

8. Glazing as in claim 7, wherein the pump is reversible, the whole being arranged so that in the mode of filling the enclosure the pump sucks in the gas present in the enclosure and blows it into the bubbler or bubblers, and wherein the mode of emptying the enclosure the pump sucks out the liquid and propels it to the upper portion of the enclosure so as to set it streaming down the walls.

9. Glazing as in claim 8, wherein the walls are of rigid material.

10. Glazing as in claim 8, wherein at least one of the walls is of flexible material.

11. Glazing as in claim 8, including at least two distributors for introducing gas into the liquid, which distributors are immersed in the liquid and are arranged to produce gas bubbles of different sizes, whereby foams having different physical characteristics can be produced.

12. Glazing as in claim 1, wherein the foam is produced by mechanical agitation of the liquid.

13. Glazing as in claim 12, wherein the walls are of rigid material.

14. Glazing as in claim 12, wherein at least one of the walls is of flexible material.

15. Glazing as in claim 12, including a device for setting liquid streaming down the walls.

16. Glazing as in claim 12, including at least one second enclosure intended for a liquid filling.

17. Glazing as in claim 1, wherein the walls are of rigid material.

18. Glazing as in claim 1, wherein at least one of the walls is of flexible material.

19. Glazing as in claim 1, including a device for setting liquid streaming down the walls.

20. Glazing as in claim 1, including at least one second enclosure intended for a liquid filling.

* * * * *

UNITED STATES PATENT AND TRADEMARK OFFICE

CERTIFICATE OF CORRECTION

PATENT NO. : 5,386,672

DATED : February 7, 1995

INVENTOR(S) : Francois Iselin

It is certified that error appears in the above-identified patent and that said Letters Patent is hereby corrected as shown below:

On the title page, at [76] please delete "Franois" and insert in lieu thereof --Francois--.

Signed and Sealed this

Twentieth Day of June, 1995

*Attest:*

Bruce Lehman

BRUCE LEHMAN

*Attesting Officer*

*Commissioner of Patents and Trademarks*